US005224413A

United States Patent [19]

Herner

[11] Patent Number: 5,224,413

[45] Date of Patent: Jul. 6, 1993

[54] IMPACT DAMPENING MEANS FOR POWER CYLINDERS

[75] Inventor: Ray H. Herner, Brookville, Ohio

[73] Assignee: Mosier Industries, Inc., Brookville, Ohio

[21] Appl. No.: 912,299

[22] Filed: Jul. 13, 1992

[51] Int. Cl.[5] ..... F01B 11/02

[52] U.S. Cl. ..... 92/85 R; 188/322.22

[58] Field of Search ..... 188/322.18, 322.19, 188/322.22; 92/7, 85 R, 84

[56] References Cited

U.S. PATENT DOCUMENTS

| | | | |
|---|---|---|---|
| 2,981,232 | 4/1961 | Peras | 92/85 R |
| 2,984,529 | 5/1961 | Dailey | 92/85 R |
| 3,465,650 | 9/1969 | Gluck | 92/85 R |
| 3,913,460 | 10/1975 | Wright | 92/85 R |
| 4,609,135 | 2/1986 | Elliesen | 188/322.22 |

FOREIGN PATENT DOCUMENTS

| | | | |
|---|---|---|---|
| 602412 | 2/1960 | Italy | 92/85 R |

*Primary Examiner*—Thomas E. Denion

*Attorney, Agent, or Firm*—Biebel & French

[57] ABSTRACT

An impact dampening ring is disclosed having a primary bumper and a secondary bumper for dampening the engagement of a piston against an end of a power cylinder. The primary bumper has a curved or arcuate surface for initial engagement with the end of the cylinder and the secondary bumper has a flat surface for secondary engagement with the end of the cylinder. The engagement of the primary and secondary bumpers dampens the impact and prevents the piston from directly engaging the end of the power cylinder. A mounting flange on the impact dampening rings provides a means for mounting the impact dampening ring onto a mounting surface of the piston. A seal along the outer perimeter of the impact dampening ring provides a fluid tight seal for the piston inside of the power cylinder.

3 Claims, 2 Drawing Sheets

IMPACT DAMPENING MEANS FOR POWER CYLINDERS

BACKGROUND OF THE INVENTION

This invention relates to a dampening or absorbing element for absorbing the impact of pistons upon the ends of a power cylinder. More specifically, this invention relates to an impact dampening element positioned on the ends of the cylinder or the facing surfaces of the piston for absorbing the impact of the piston against the cylinder end and preventing the piston from directly engaging the ends of the cylinder.

Generally, there are various types of impact elements used to dampen the impact of a piston against the ends of a cylinder at the end of each piston stroke in order to reduce the noise which may result from metal-to-metal contact as the piston engages the cylinder ends. The co-owned wright U.S. Pat. No. 3,913,460 discloses a dampening or cushioning piston impact element in the form of a contoured impact ring. The ring incorporates a resilient bumper portion and a resilient sealing lip. The sealing lip entraps the cylinder fluid between the piston and the cylinder end at the end of the piston stroke to provide an initial slowing of the piston as the piston approaches the end of the cylinder.

The main impact dampening effects of the '460 patent are performed by the bumper portion of the impact ring. As the piston moves into close proximity to one of the cylinder end walls, the bumper portion is compressed between the piston and the cylinder end wall such that the bumper portion absorbs the energy of the impact. The bumper is designed such that under normal operating conditions the piston will not engage the cylinder end.

As the velocity of the piston within the cylinder is increased or the weight of any element actuated by the piston is increased, the load exerted on the bumper portion will also increase such that under certain extreme operating conditions the bumper portion may compress sufficiently to permit metal-to-metal contact between the piston and the cylinder end. This contact between the piston and cylinder typically produces undesirable noise which the impact dampening element is intended to prevent.

Accordingly, there is a need for an impact dampening element which provides increased protection against contact between the piston and the cylinder end in the event that large loads are applied to the piston. In addition, there is a need for an impact element capable of absorbing increased loads and which retains the initial deceleration characteristics of prior art impact absorbing elements.

SUMMARY OF THE INVENTION

The present invention provides an improved impact dampening element for use with a power cylinder, and particularly with a double-acting cylinder. Such a power cylinder includes a cylinder housing having first and second end faces and a piston having first and second end surfaces moveable between the end faces of the cylinder. The impact dampening element forms an impact-absorbing cushion between the end surfaces of the piston and the end faces of the cylinder.

The impact dampening element has a body portion which defines a facing surface. A primary bumper extends from the facing surface of the body portion a first distance in a direction substantially perpendicular to the facing surface of the body portion. A second bumper extends from the facing surface of the body portion a second distance which is less than the first distance of the primary bumper. The secondary bumper is substantially parallel to the primary bumper.

The primary and secondary bumpers are formed to absorb the impact and prevent contact between the end surface of the piston and the end face of the cylinder at the end of each stroke of the piston.

Accordingly, objects of the present invention are to provide an impact dampening element which prevents the end surface of a piston in a power cylinder from directly impacting the end face of the cylinder; and to provide an impact dampening ring which provides improved deceleration and absorption of the impact of a piston in a power cylinder against the end of the cylinder.

Other objects and advantages of the present invention will be apparent from the following description, the accompanying drawings and the appended claims.

DETAILED DESCRIPTION OF THE EMBODIMENTS

Figure 1:
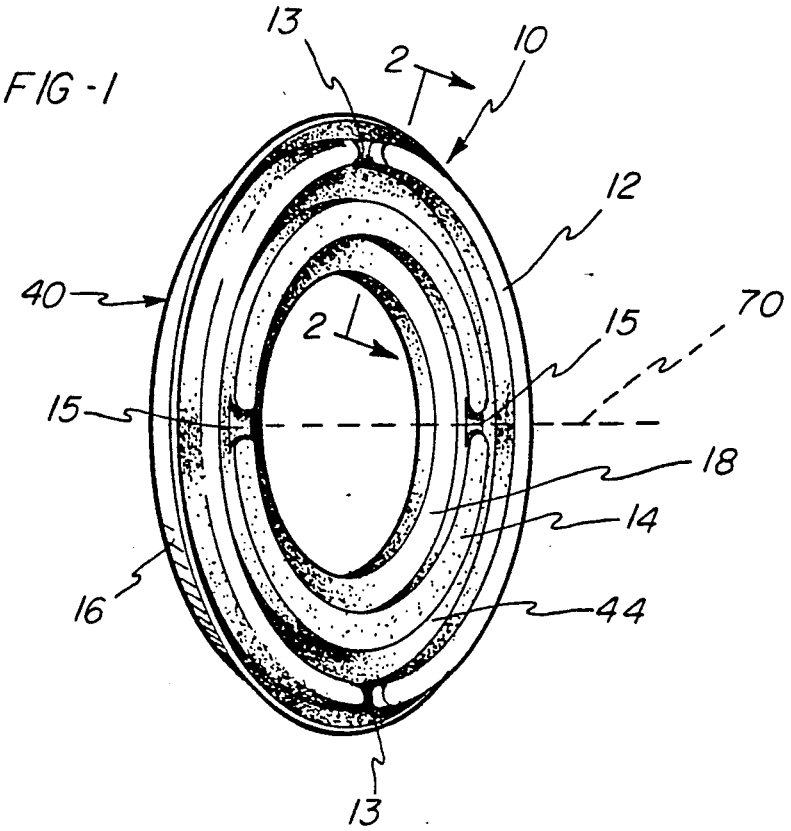
FIG. 1 is a perspective view of the impact dampening ring of the present invention.
Figure 2:
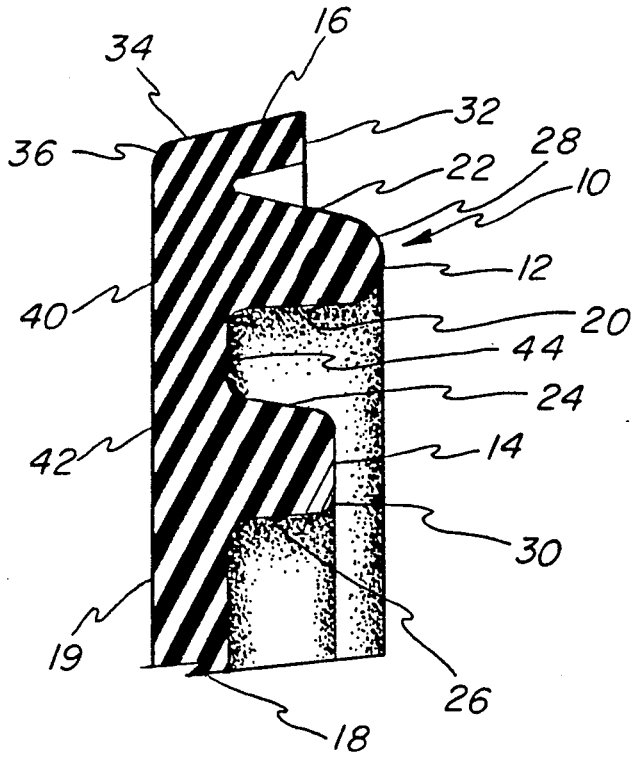
FIG. 2 is a cross-sectional view of the impact dampening ring taken along line 2—2 in FIG. 1.

An impact dampening ring in accordance with the present invention is shown in FIGS. 1 and 2 and is generally indicated by reference numeral 10. The impact dampening ring 10 has a body portion 40 formed of resilient rubber-like material and includes a front surface 44 and a back surface 42. The impact dampening ring has a generally circular shape and is formed symmetrically about a center axis 11. The back surface 42 is planar and perpendicular to center axis 11.

The impact dampening ring 10 has an annular primary bumper 12 and an annular secondary bumper 14 which are concentric about the center axis 11. The primary bumper 12 includes radially inner and outer side walls 20, 22 extending in converging relation from the front face 44 and an arcuate primary engaging surface 28 extending between the side walls 20, 22. In addition, the configuration of the primary bumper 12 is such that this bumper 12 provides an initial impact dampening between a cylinder and a piston moving within the cylinder such that the piston will undergo deceleration at a controlled rate. It should be noted that the primary bumper 12 may have a configuration substantially similar to the energy absorbing bumper structure disclosed in U.S. Pat. No. 3,913,460, which patent is incorporated herein by reference.

A secondary bumper 14 extends from the front face 44 of the ring 10 in a direction parallel to the primary bumper 12. The secondary bumper 14 includes first and second side walls 24, 26 and a substantially flat secondary engaging surface 30 extending between the side walls 24, 26. The height of the secondary bumper 14, as defined by the distance of the secondary engaging surface 30 from the front face 44, is substantially less than the height of the primary bumper 12, as defined by the distance from the primary engaging surface 28 to the front face 44.

A mounting flange 18 extends radially inwardly from and perpendicular to the secondary bumper 14. The flange 18 includes a rear surface 19 coplanar with the back surface 42 of the body portion 40 and is formed to mount inside a lip on a mounting surface, which will be further discussed below.

The relative heights of the primary and secondary bumpers 12, 14 from the facing surface 44 of the body portion 40 are selected such that an initial impact and dampening is performed by the primary bumper 12 and a secondary dampening function is accomplished by the secondary bumper 14 after the primary bumper 12 has been compressed a predetermined amount. Further, it should be noted that the primary and secondary bumpers 12, 14 are provided with fluid vent passages 13, 15, respectively, such that each of the bumpers 12, 14 is divided into two semi-circular portions, although it should be noted that the bumpers 12, 14 may also be formed of more than two portions separated by a plurality of vent passages and located in a circular pattern around the body portion 40. The vent passages permit radial fluid flow across the front face 44 during compression of the bumpers 12, 14 such that any fluid pressure developed across the front face 44 is distributed substantially evenly across the face 44.

The ring 10 further includes a flexible annular seal portion 16 located adjacent the primary bumper 12 and formed as a thin skirt element as compared to the width of the primary and secondary bumpers 12, 14. The seal portion 16 flares outwardly extends forwardly from the front face 44 a distance less that the distance of extension of the primary and secondary bumpers 12, 14 from the body portion 40. This ensures that as the ring 10 operates to cushion the impact between a piston and the end of a cylinder, the bumpers 12, 14 will absorb the full impact load while avoiding any impacting contact with the seal portion 16.

In addition, the seal 16 includes an outer sealing surface 34 formed as an extension of an outer perimeter 36 of the body portion 40 wherein the sealing surface 34 diverges slightly from the outer perimeter. In use, the seal portion 16 forms a seal between a piston and a surrounding cylinder wall to prevent fluid from passing between an outer wall of the piston and the cylinder wall, as is more fully described in the above-noted U.S. Pat. No. 3,913,460.

Figure 3:
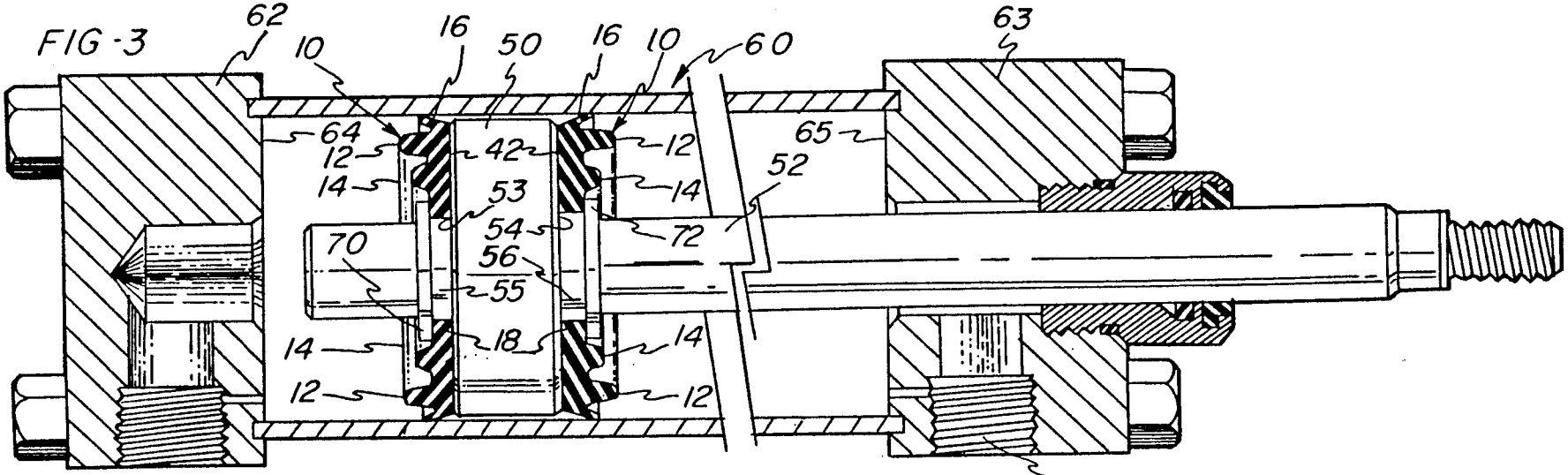
FIG. 3 is a view in axial section of a power cylinder incorporating the impact dampening ring of the present invention in which the cylinder housing and impact ring are shown in cross-section.
Figure 5:
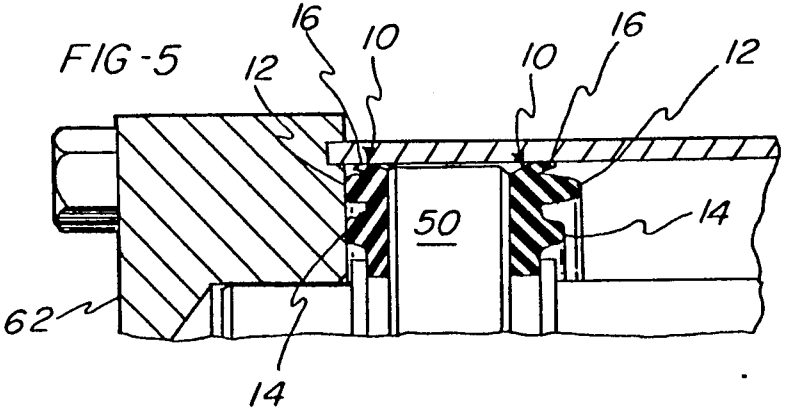
FIG. 5 is a sectional view similar to FIG. 3 with the primary and secondary bumper of the impact dampening ring of the present invention being compressed against the cylinder end.
Figure 4:
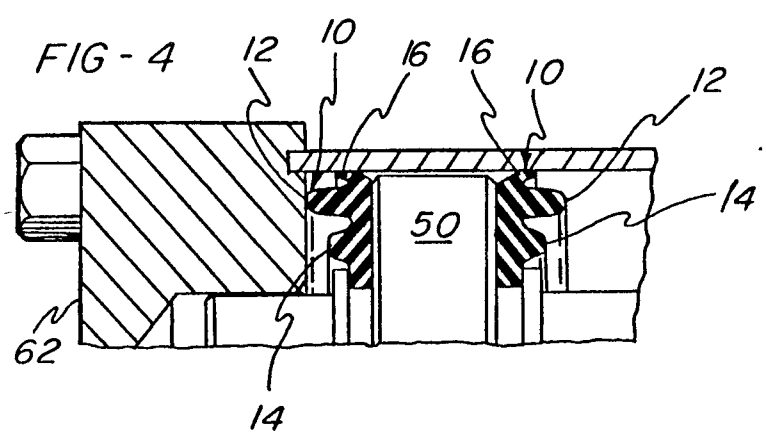
FIG. 4 is a sectional view similar to FIG. 3 with the primary bumper of the impact dampening ring of the present invention compressed against the end of the cylinder.

FIGS. 3-5 illustrate the impact ring 10 of the present invention in use in combination with a power cylinder including a cylinder housing 60 and a piston 50, wherein the piston 50 reciprocates between end plates 62, 63 located on opposing ends of the cylinder housing 60 and having respective end faces 64 and 65. A rod 52 may be attached to the piston 50 for reciprocating movement with the piston 50 to move an actuated element (not shown) as the power cylinder is actuated. In addition, each of the end plates 62, 63 is provided with an aperture or port 68, 69 whereby a fluid, such as a pneumatic or hydraulic fluid, fed under pressure may be supplied to the interior of the cylinder housing 60 for actuating the piston 50 in its reciprocating movement.

As seen in FIG. 3, an impact dampening ring 10 is mounted to each end of the piston 50. The piston 50 has first and second end surfaces 53, 54 to which the back surfaces 42 of respective rings 10 are mounted.

Referring to FIG. 3, the piston 50 includes radially outwardly extending flanges 70, 72 spaced from respective end surfaces 53, 54. The flanges 70, 72 and end surfaces 53, 54 define recesses 55, 56 therebetween for receiving the flanges 18 of respective impact rings 10 whereby the rings 10 are held in engagement with the ends of the piston 50. With the rings 10 thus in position, the seal 16 of each of the rings 10 is located in sealing contact with the inner wall of the cylinder housing 60 and any fluid pressure applied to either end of the piston 50 will further bias the seals 16 into contact with the cylinder wall.

Referring to FIG. 4, the piston 50 is near the end of its stroke and is approaching the end face 64 of end plate 62. As wherein the primary bumper 12 of the impact dampening ring 10 engages the end face 64 of the end plate 62. The primary bumper 12 is compressed and absorbs the impact of the piston against the end plate 62. The impact dampening ring 10 is designed such that during the impacting and compressing of the primary bumper 12 against the end face 64, there is sufficient space surrounding and/or inside the bumper 12 to accommodate the compressed portions of the primary bumper 12 deflected radially by compression against the end face 64.

In FIG. 5, the piston 50 is seen at the very end of its stroke wherein the secondary bumper 14 engages the end face 64 of the end plate 62. The secondary bumper 14 causes the deceleration of the piston 50 to occur at an increased rate compared to the primary bumper 12 due to the relatively wide engaging surface 30, as compared to the height of the bumper 14, which provides a relatively stiff impact cushioning element. In addition, the secondary bumper 14 acts in combination with the primary bumper 12 such that the movement of the piston 50 is effectively terminated before the piston 50 contacts the face surface 64. Further, it should be noted that the impact ring 10 on the opposing side of the piston operates in an identical manner as it contacts face surface 65 on end plate 63.

The configuration of the present impact ring 10 ensures that the piston 50 will decelerate at a controlled predetermined rate after contact of the primary bumper 12 with the face surface 64 while avoiding undesirable rebound effects which may result if the primary bumper 12 were stiffened to absorb all of the anticipated impact forces. The secondary bumper 14 complements the operation of the primary bumper 12 in that the secondary bumper 14 is engaged after most of the momentum force of the piston 50 has been absorbed by the primary bumper 12, and the secondary bumper 14 absorbs any residual energy of the piston 50 in order to prevent direct contact between the piston 50 and the end plate 62 at the end of the stroke.

The impact ring of the present invention provides an effective cushioning device for preventing direct contact between a piston and a cylinder end face whereby noise which would result from such contact is prevented. In addition, the present invention provides such an impact ring incorporating primary and secondary bumpers while retaining the beneficial deceleration characteristics provided by a single compliant bumper element having the configuration of the primary bumper element of the present invention. Furthermore, under preferred operating conditions for the impact ring, the majority of the deceleration for the piston will occur prior to contact with the secondary bumper.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In combination with a piston which reciprocates in a cylinder having a predetermined inner diameter and a substantially flat end face, an impact absorbing and sealing member on an end of said piston to cushion movement thereof into contact with said end face of said cylinder, comprising:

(a) a cylindrical main body of resilient rubber-like material having an axially outer end and an axially inner end, (b) means for mounting said inner end of said body to an end of said piston, (c) said body including three concentric and radially spaced annular portions on said outer end thereof, (d) the radially outermost of said three annular portions being formed as a flaring skirt proportioned for sealing engagement with the surrounding wall of said cylinder, (e) the radially innermost of said annular portions being of substantial radial thickness and having an essentially flat axially outer end surface to form a bumper limiting movement of said piston toward the adjacent end of said cylinder, (f) the intermediate one of said three annular portions being of greater axial length than the other said annular portions and including a peripheral end portion normally located axially beyond said innermost and outermost annular portions for initial contact with and deflection by said cylinder end wall upon approach of said piston thereto, and (g) said body having annular grooves between said annular portions which are of sufficient depth and radial width to receive said deflected end portion and thereby to provide for direct contact between said cylinder end wall and said innermost annular portion.

2. The combination defined in claim 1 further characterized in that said innermost annular portion is of greater length than said outermost annular portion and also is proportioned to prevent contact between said outermost annular portion and said cylinder end wall.

3. The combination defined in claim 1 further comprising radially extending passages in said peripheral end portion of said intermediate annular portion for passage of fluid between said innermost and intermediate annular portions and said cylinder end face.

* * * * *